US008459002B2

(12) United States Patent
McLean et al.

(10) Patent No.: US 8,459,002 B2
(45) Date of Patent: Jun. 11, 2013

(54) EFFICIENT RF ELECTROMAGNETIC PROPULSION SYSTEM WITH COMMUNICATIONS CAPABILITY

(76) Inventors: John P. McLean, Fort Worth, TX (US); David R. McLean, Plano, TX (US)

( * ) Notice: Subject to any disclaimer, the term of this patent is extended or adjusted under 35 U.S.C. 154(b) by 978 days.

(21) Appl. No.: 12/611,975

(22) Filed: Nov. 4, 2009

(65) Prior Publication Data

US 2010/0326042 A1 Dec. 30, 2010

Related U.S. Application Data

(60) Provisional application No. 61/200,202, filed on Nov. 25, 2008.

(51) Int. Cl.
*F03H 1/00* (2006.01)

(52) U.S. Cl.
USPC ..... 60/202

(58) Field of Classification Search
USPC ..... 60/202; 315/111.41, 111.61, 501, 315/506; 313/359.1, 362.1
See application file for complete search history.

(56) References Cited

U.S. PATENT DOCUMENTS

| | | | | |
|---|---|---|---|---|
| 3,321,919 | A * | 5/1967 | Marolda | 376/319 |
| 3,638,058 | A * | 1/1972 | Fritzius | 313/359.1 |
| 5,142,861 | A | 9/1992 | Schlicher et al. | 60/203.1 |
| 5,197,279 | A | 3/1993 | Taylor | 60/203.1 |
| 6,118,193 | A * | 9/2000 | Morris | 310/74 |
| 6,145,298 | A * | 11/2000 | Burton, Jr. | 60/202 |
| 6,492,784 | B1 | 12/2002 | Serrano | 315/506 |
| 7,190,108 | B2 | 3/2007 | La Borde | 313/358 |
| 7,602,111 | B2 * | 10/2009 | Lee | 313/231.31 |
| 8,112,982 | B2 * | 2/2012 | Metcalfe et al. | 60/204 |
| 2009/0113872 | A1 * | 5/2009 | Demmons et al. | 60/202 |

FOREIGN PATENT DOCUMENTS

| | | |
|---|---|---|
| FR | 1.586.195 | 2/1970 |
| FR | 2.036.646 | 12/1970 |
| JP | 58-32976 | 8/1956 |
| JP | 1-268467 | 10/1989 |

* cited by examiner

*Primary Examiner* — Phutthiwat Wongwian
(74) *Attorney, Agent, or Firm* — Charles D. Gunter, Jr.

(57) ABSTRACT

An electronic propulsion engine that creates a propulsive force or thrust using electromagnetic forces or electrostatic forces, with an effect that is similar to the thrust of a jet or rocket engine. Forces are generated using electromagnets or capacitor plates that are separated by dielectric spacer cores and are operated with two modulated currents. The two modulated currents are synchronized, but with a relative phase such that the forces on the two magnets or capacitor plates are not balanced. Included are techniques to reduce circuit impedance and control electric-magnetic field dispersion, such as tuned LCR circuits, dielectric core materials between the magnets or capacitor plates, and RF superconductors result in high propulsion efficiencies. The system operates at RF frequencies and can also be used as a communication device.

16 Claims, 8 Drawing Sheets

EFFICIENT RF ELECTROMAGNETIC PROPULSION SYSTEM WITH COMMUNICATIONS CAPABILITY

CROSS REFERENCE TO RELATED APPLICATIONS

The present application claims priority from an earlier filed provisional patent application Ser. No. 61/200,202, filed Nov. 25, 2008, by the same inventors.

BACKGROUND OF THE INVENTION

1. Field of the Invention

The present invention generally relates to propulsion technologies for use with space, air and other vehicles; more specifically to a propulsion system based entirely on electric and electromagnetic forces, and including methods that provide high efficiency.

2. Description of the Prior Art

The following references represent the closest prior art known to Applicants at the time of the filing of the present application:

US Patent Documents:

| | | |
|---|---|---|
| 5,142,861 | September 1992 | USA |
| 5,197,279 | March 1993 | USA |
| 6,492,784 | December 2002 | USA |
| 7,190,108 | April 2007 | USA |

Foreign Patent Documents:

| | | |
|---|---|---|
| 1586195 | February 1970 | France |
| 2036646 | December 1970 | France |
| 58-32976(A) | February 1983 | Japan |
| 1268467A2 | October 1989 | Japan |

Of the above references, the closest prior art reference appears to be that which is described in Japanese Patent JP1268467A2, entitled "Electromagnetic Propulsion Device." This prior art also uses two electromagnet coils that are separated by a distance, and are operated with two modulated currents in a manner similar to the present invention. It, however, does not appear to use any improvements in efficiency, such as the techniques to reduce the effects of circuit impedance. Without these improvements, this prior art has an electrical efficiency considerably less than that for current Ion Engine technology (the DS1 Ion engine is used here as a baseline). A quick calculation indicates that, as it is, for a 2000 watt input (like the DS1 engine), this design produces about $10^{-6}$ Newtons thrust. The DS1 Ion Engine produces about 0.092 Newtons (0.33 oz.) thrust. The significance of the efficiency improvements included in the current invention's design will be discussed at length within this specification. Also, as discussed in the section entitled "Basic Embodiment Operations", this prior art is essentially a two element array antenna.

Another concept that is based on magnetic forces is described in U.S. Pat. No. 5,142,861, entitled "Nonlinear Electromagnetic Propulsion System and Method." This design, however, uses a single antenna and operates at a very low frequency, as opposed to multiple circuits and a higher frequency for the subject invention. Because of the very high currents required, cryogenic cooling and superconducting conductor materials are also required. According to the analysis done in this prior art description, that design could have an efficiency of from several times up to about 20 times that of the DS1 Ion Engine. This analysis however does not appear to include the power required for cooling, which reduces the system's efficiency significantly.

A third prior art reference which discusses principles similar to the present invention is described in U.S. Pat. No. 5,197,279, entitled "Electromagnetic Energy Propulsion Engine." There are, however, a number of factors that distinguish Applicant's invention from this prior work. This prior work required superconducting electromagnets, whereas the subject invention, while not requiring it, can use a superconducting electromagnet to possibly improve efficiency. The concept of magnetic field phase and propagation speed apparently did not factor into the prior work. As such, there was no effort in this prior art to use the concept of signal phase change due to signal propagation. While no power requirements were calculated in the prior work, it appears that it required very large amounts of electrical power to operate. Also, while that concept used pulsed currents (pulsed at about 1 KHz), there was no mention of the use of losses that occur in superconducting electromagnets from these pulsed currents.

The largest difference, however, between that prior work and Applicant's invention appears to be how these two concepts work and the associated assumptions about magnetic field interactions. The present invention is based on forces exerted on electric charges moving through a magnetic field. This is an accepted phenomenon, and the elementary basis for magnetic field theories in all the physics and engineering electromagnetism texts that we have seen or studied. However, the prior work relies on an assumption that two magnetic fields exert forces on each other (as opposed to forces on electrical currents). This assumption is not supported by any theories that we are aware of, and appears to be a flaw in the prior work's use of magnetic field interactions; interactions which are the basis for the operation of the prior Electromagnetic Energy Propulsion Engine concept.

The conceptual photon propulsion system is another system that is similar to this concept. Photon propulsion, however, is a very inefficient technique. A focused photon beam with a power of P watts, produces a thrust of P/C Newtons (where "C" is the speed of light in meters/second), which is comparable to this concept without any of the efficiency improvements described below.

The Japanese Patent 58-32976(A) and the French Patents 1586195 and 2036646 listed above also bear some similarity to the principles utilized in the present invention. However, none of these concepts appear to utilize forces on electrical currents in magnetic fields, or the concept of out of phase forces to create a positive net force. Although the Japanese patent document describes the production of strong magnetic fields, the only electromagnetic energy that propagates away from the vehicle exists in the form of photons. These photons irradiate into space by emanating from a wave guide to a concave surface of a parabolic member where they are reflected and then pass through pulsing high-frequency magnetic fields. Alternatively, photons are generated when free electrons in conductors are caused to be either accelerated or decelerated in the process of producing strong magnetic field pulses. Also the only electromagnetic energy that departs from the vicinity from either of the French devices exists in the form of photons that are radiated into space, the photons being generated in the acceleration or deceleration of free electrons used to produce the electromagnetic field pulses of the inventions. Each of these concepts appear to create a propulsion force entirely from the propagation of photons (as does the conceptual photon propulsion system), and as a result each has very low efficiencies.

Another body of prior art which is relevant to the concepts embodied in the present invention is art which includes such teachings as those described with respect to any antenna system that focuses RF energy, similar to the present invention, and similar to the teachings of this invention and that disclosed in Japanese Patent JP1268467A2. These concepts will be discussed more thoroughly in the written description which follows.

The systems described in U.S. Pat. Nos. 6,492,784 and 7,190,108 also appear to be similar to this EM Propulsion System. As in the first previous prior art above, neither of these appear to consider the effects of electrical circuit impedance. Neither use methods to improve efficiency, such as the techniques to reduce the effects of circuit impedance. U.S. Pat. No. 7,190,108 is an electromagnetic design that is essentially arrays of RF antennas that operate at a very high radio frequency. As a result, it is highly affected by circuit impedance. U.S. Pat. No. 6,492,784 is an electrostatic design which is also affected by circuit impedance. In addition to not including the effects of electrical circuit impedance, this prior invention appears to be based on an incomplete electrostatic force analysis. This results in a net force on the system that is not supported by electrostatic theory.

SUMMARY OF THE INVENTION

The original object for the present invention was to develop a new propulsion concept for use in a wide variety of applications, including (but not limited to) for use in air and space military and civilian vehicles. Later that object was re-focused to develop a near term system that provided an improvement in thrust and efficiency over that of the systems currently available to NASA, DOD and for other governmental and commercial uses. The Deep Space 1 probe, launched on Oct. 24, 1998, with its xenon ion engine, was our original target for comparison. This ion engine used 2000 watts electrical power (and an 81.5 Kg supply of xenon gas propellant) to produce a thrust of 0.09 Newtons (0.33 oz.). The newer ion engines have similar efficiencies. After considerable design and analysis, it appears that thrust levels considerably higher than this are possible using the present invention. The original object remains for the long term.

This invention has a number of advantages over other advanced propulsion concepts. One important advantage is that this form of propulsion requires only electrical power for operation. No supply of propellant is required, thus it has an infinite specific impulse. From simulation data, this invention also appears to be much more efficient than any current or proposed advanced propulsion concepts that we are aware of (including photon, ion & plasma). It can be used for deep space propulsion and possibly within the atmosphere. This invention can operate in complete silence, and without any disturbances to its surroundings. It appears possible to build air and space vehicles using said systems that do not require aerodynamic forces: uses no wings, props or jet exhausts, can operate in confined spaces, can operate in highly turbulent atmospheres. This propulsion concept uses circuits that operate in the radio frequency (RF) spectrum. As such, it can also be used as an RF communication system.

This invention develops a propulsion technology concept that is based entirely on magnetic forces. It uses two electromagnets, which are separated by a short distance and are operated with modulated currents such that the forces on the two magnets are not balanced. This imbalance results in a force on the system of the two magnets similar to the thrust produced by a jet or rocket engine, except without the propellant requirement, and without the noise and other disturbances from an exhaust. The concept includes techniques that reduce losses and results in high propulsion efficiencies. Its operation in the RF spectrum allows it to perform the second function of communication.

BRIEF DESCRIPTION OF THE DRAWINGS

FIG. 2A shows two wires that carry a DC current. FIG. 2B shows two wires carrying the AC current waveforms shown in FIG. 1D, and the waveforms seen be each after propagation delays.

FIG. 3A shows a side view of the Embodiment, and FIG. 3A shows the controller computer links.

FIG. 5A shows a side view of the principal parts of a three circuit back-to-back embodiment system. FIG. 5B shows a design that uses a reflector lens and a single EM coil.

FIG. 6A shows a basic building block for this embodiment and FIG. 6B an exploded 3-D view of the individual major circuits. FIGS. 6C and 6D show top and side views of the system. Also shown is the x-y-z coordinate system used here.

FIG. 8A shows a system that uses entirely electro-static forces, and FIG. 8B shows a system that combines electromagnetic and electrostatic forces.

DETAILED DESCRIPTION OF THE INVENTION

Figure 1A:
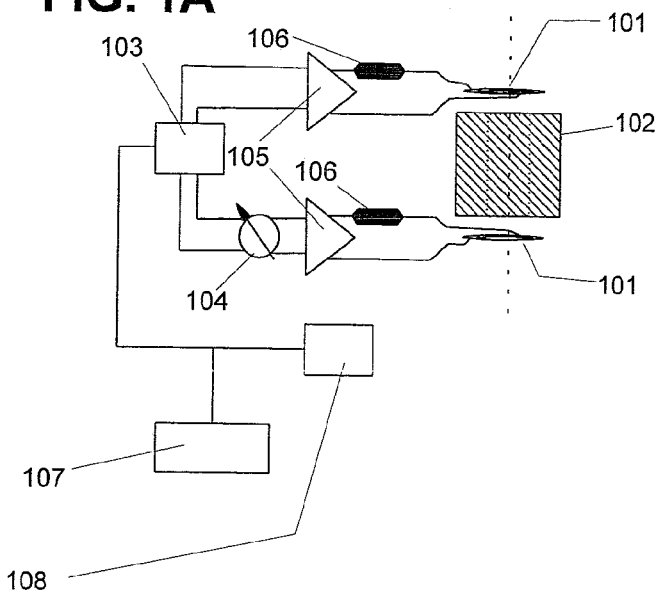
FIGS. 1A to 1E show various views and components of the Basic Embodiment system. Shown are Side (FIG. 1A), Top (FIG. 1B), Schematic (FIG. 1C), the normalized signal waveforms (FIG. 1D) for the two circuits, and controller computer links (FIG. 1E).

The descriptions and operations for the embodiments within this document include three major embodiments. The first two embodiments are based on use of electro-magnetic forces. The first is a basic embodiment that is probably the simplest to understand. It also includes several embodiment improvements. The second is the preferred embodiment and is based on the first embodiment. The third embodiment is similar to the first, except it is based on electro-static forces. Each of the embodiments can be developed independently of the others.

The following reference numbers are used in the Drawings and in the description which follows:

101. Electromagnetic Circuits (EM Coils)
102. Circuit spacer core material (made from a medium having a slow EM signal propagation speed)
103. Master oscillator/Signal Generator
104. Phase shift circuit (90, 180 or 270 degree shift)
105. Signal amplifier
106. Circuit tuning capacitor
107. Power Supply

108. Cooling
109. Controller
110. Circuit resistance
111. Impedance matching network or transformer
112. Mechanical Structure
121. Signal waveform (shown normalized) at signal generator that is sent to top circuit (wire)
122. Signal waveform (shown normalized) at signal generator that is sent to bottom circuit (wire)
121*a*. Signal waveform (121) as seen at top wire
121*b*. Signal waveform (121) as seen at bottom wire
122*a*. Signal waveform (122) as seen at top wire
122*b*. Signal waveform (122) as seen at bottom wire
301. Auxiliary Electromagnetic Circuits (Coils)
302. Auxiliary Circuit tuning capacitor
303. Auxiliary Signal amplifier
501. Reflector lens
601. Power amplifier circuit board
602. End cap
701. Signal Generator and phase shifters circuit board
702. Preamplifier and driver amplifier
703. Precision bridge/combiner circuit
801. Variable inductance coil
802. Parallel plate capacitor
803. Parallel plate capacitor core material

Figure 1B:
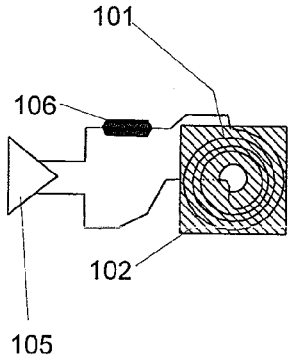

DETAILED DESCRIPTION—BASIC EMBODIMENT—FIGS. 1A And 1B

Figure 1C:
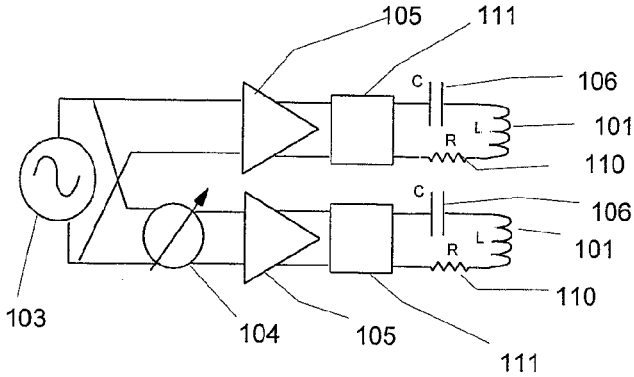
Figure 1D:
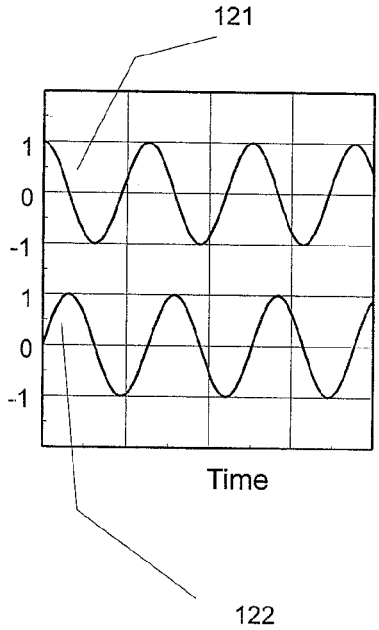

This invention embodiment is made up of twelve principal parts: two electromagnetic (EM) circuits 101 (coils), a spacer core 102 made of dielectric materials that separate the two EM coils, signal generator 103 and amplifier circuits that power the two EM coils, a 90 degree phase shifter 104 in one of the circuits, tuning capacitors 106, a system controller 109, and power 107 and cooling 108 systems. FIGS. 1A, 1B and 1C show these parts and their layout. FIGS. 1A and 1B show side and top views respectively for the principal parts. FIG. 1C shows a schematic diagram of the electronic circuits for this system. The system also uses a mechanical structure that is used primarily to maintain the geometry between the two EM coils. This structure is made of plastic, ceramic or a material with similar structural and electrical characteristics.

The two EM coils 101 are essentially two flat coils that are each wound in a spiral form that is shaped similar to a disk, as seen in FIGS. 1A and 1B. The two coils are matched as precisely as possible in terms of geometry, electrical resistance and inductance. The circuit resistance 110 includes all the electrical resistance sources, including that of the EM coils 101, connecting wiring, and the output or matching circuits of the amplifier 105. The coils need to be made using very low resistance high voltage wire. AWG12 and larger stranded wires with insulations rated at 15 KV DC and higher have been investigated as a baseline configuration. The coils are mounted along a common axis, and separated by a short distance. This distance is determined by the frequency generated by the signal generator 103 and the electrical characteristics of the circuit spacer core 102. The distance requirement will be discussed in the operation section that follows. Each of the EM coils is individually tuned, using the tuning capacitors 106, to the operating frequency of the signal generator 103 and amplifier circuits 105.

The spacer core is indicated in Component 102 in FIGS. 1A and 1B. It is made from a material having a high resistance, very high dielectric coefficient and high electrical breakdown voltage. Barium Titanate is such a dielectric material, having a dielectric coefficient up to about 10,000 and a dielectric strength of up to about 300V per mil. The high dielectric coefficient results in an EM field propagation speed that is considerably less than that for air or a vacuum. The implications of EM field propagation speed will be discussed in the next section.

Figure 1E:
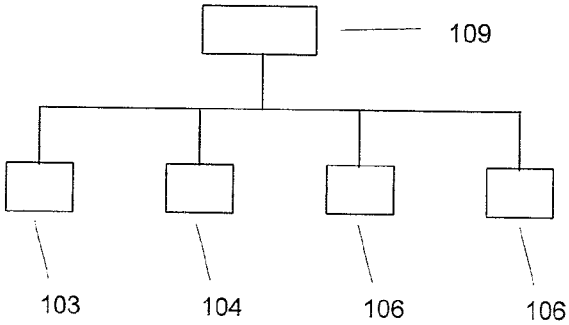

The two EM coils are powered by one signal generator, one phase shifter and two high efficiency amplifier circuits (see FIG. 1A) that result in two (sine wave) signals having the same frequency, but with one 90 degrees out of phase with the other (121 and 122). The phase shifter 104 can be either plus or negative 90 degrees. The amplifiers 105 need to be designed such that their output impedance is very low to match that of the two tuned EM coils 101. The signal generator 103 operates under control of the control computer 109, and is capable of being tuned (center frequency) and modulated with a variable narrow bandwidth frequency modulation (FM). The control computer 109 also controls the phase shifter 104 and the two circuit tuning capacitors 106 as shown in FIG. 1E. The output from the signal generator is split into two paths, with the first signal going directly to the amplifier 105 for circuit A. The second signal path includes a phase shifter circuit 104, which provides a selectable phase shift of ±90°, followed by the second amplifier 105 for circuit B. The circuit resistance 110 includes all the electrical resistance sources, including that of the EM Coils 101, connecting wiring, and the output or matching circuits of the amplifier 105. The two sets of coils and connecting wiring need to be matched as closely as possible, and all connecting wiring be as short as possible.

The EM coils 101 and spacer core 102 are stabilized and held together using a structural member 112 that is made from a plastic, ceramic or similar material. This structure must be such that it has little effect the EM fields. Shielding can also be added if needed for EMI considerations.

As a comparison, FIG. 1A, without the spacer core 102 and tuning circuits 106 appears to be similar to the design of the prior art described in Japanese Patent JP 1268467A2, entitled "Electromagnetic Propulsion Device." However, the dielectric spacer core 102, tuning circuits 106 and unique features of the electronic circuits used in the practice of the present invention are added to improve the system's efficiency in producing thrust.

Figure 2A:
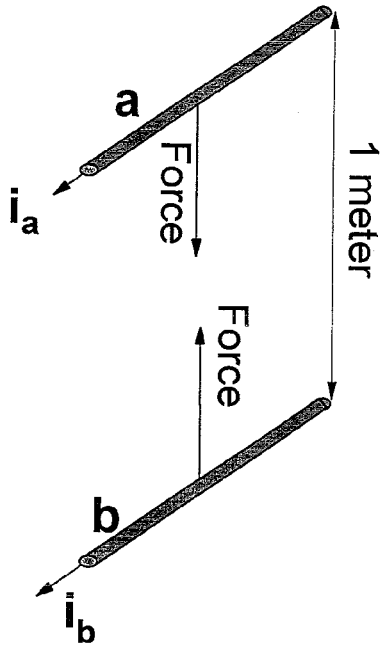
FIGS. 2A and 2B show the concept of magnetic forces on electrical current carrying wires.
Figure 2B:
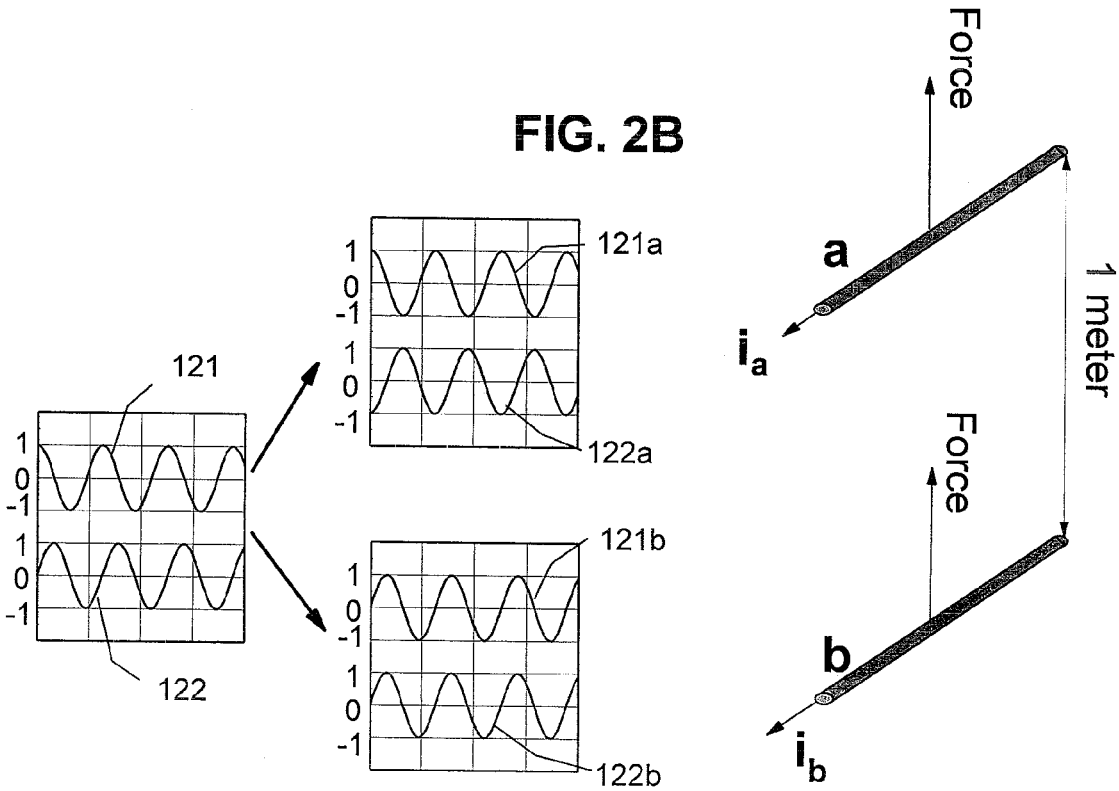

Operation—Basic Embodiment—FIGS. 2A and 2B

1. Background.

While some may say this invention appears to violate the laws of physics, it is based on and achieves its performance from a combination of well established concepts (primarily classical electromagnetic theory as developed by Maxwell) and, as described in the alternative embodiments, several recent and developing technologies.

Consider two short parallel wires (a and b as in FIG. 2A) in air or a vacuum, fixed relative to each other and separated by a distance of one meter. Further, suppose that each is carrying a constant (DC) current that is flowing in the same direction. As a result of the magnetic fields generated by the currents, a force is generated between the two wires that attracts each to the other. These forces are equal but in opposite directions, resulting in a zero net force on the system of wires. The total force on this system is balanced.

Now, let us replace the DC current with an alternating current (see FIG. 2B) that has a frequency of c/4 Hertz ("c" being the speed of light; c/4 Hz, =74.9 MHz). Also let the relative phase of the two currents be offset by 90 degrees, with the phase of a leading that of b (121 and 122). Because of the propagation delay from a to b (as illustrated in FIG. 2*b*), an observer at b observing the magnetic field from a would say the two currents are in phase (121*b* and 122*b*), thus wire b is attracted towards a. On the other hand, an observer at a would say that the phases are off by 180 degrees (121*a* and 122*a*), resulting in a repulsive force on wire a. As a result, an upwards force is exerted on each wire creating an unbalanced system. If the phase of b led that of a, then the forces would be downwards.

From a different point of view, consider the second case from above (that with the AC currents) where the phase of a leading that of b. For an observer at a long distance and above the two wires, the two magnetic fields are equal, but in opposite directions; i.e. they cancel each other. For a similar observer below the two wires, the situation is different; the two fields are the same, thus they combine to create a stronger field strength. This device is in effect, a simple array antenna that focuses (downward) the RF energy emanating from wires a and b. Since more energy (mass) is emanating downwards, according to Newton's third law of motion, there must be an upwards force on the wires.

If we replaced the two parallel wires with two co-axial coils (to increase the magnetic field) as in FIG. 1A, a similar effect occurs as with the parallel wires. With DC currents, the coils attract each other; as with the parallel wires. Also as with the straight wires above carrying AC currents having the proper frequency and phases, the forces align. The result is a net force on the system. This two coil design is the form taken in the prior art of the Japanese Patent # JP1268467A2: Electromagnetic Propulsion Device. The two coils (and two parallel wires) with AC currents as above are a form of electromagnetic propulsion. However, that prior device as it stands relies on the same principals as an un-focused photon propulsion device. It is very inefficient in terms of the ratio of achieved force to power required as indicated in the prior art discussion.

The use of coils rather than wires helps to increase the system's efficiency, however only by a little. For example, consider two tubular coils, each having 25 turns, a diameter of 1 meter and separated by 1 meter. These dimensions result in a field loss from dispersion of about 90%. In air, the separation results in a frequency required of 74.9 MHz. Each coil has an inductance of about 1350 micro Henries, with an inductive reactance of 637 K Ohms (at 74.9 MHz as above). At 2000 Watts total input, the RMS currents in each coil will be 39.6 milli-amps; the magnetic field strength at the coils' centers is 1.25E-6 Webers/meter$^2$; and the resulting force on the two coils is 7.76 E-7 Newtons. For coils with 100 turns each, this force increases to 8.08 E-7 Newtons, and 1.2 E-6 Newtons for 1000 turns. As a comparison, the photon propulsion, using 2000 watts, produces about 6.67 E-6 Newtons thrust. Without the magnetic field dispersion, this EM system would essentially match a photon system's efficiency. Fortunately, there are several changes that can be made to improve the efficiency.

Addressing System Efficiency.

The system's efficiency can be improved by a combination of reducing power requirements and/or increasing the achieved output force. Both these factors are important; one cannot be focused on at the exclusion of the other. For example, an efficient system that uses very little power, but also produces very little force is not very useful.

Some factors have little or no effect on the systems efficiency. For example, increasing the power supply voltage increases the electrical currents, and thus the forces generated. However, the power required also increases by the same amount, resulting in the same efficiency. Another way to increase the force between the coils is to reduce their separation. By shortening the separation between wires A & B, we reduce the dispersion loss in magnetic field strength from propagation from one coil to the other. This increases the force without a similar increase in currents in the coils. However, this also requires that we use a higher operating frequency. This higher frequency results in a higher circuit impedance due to the inductance of the circuits, which increases the power required.

(a) Addressing Lowering the Frequency of Operation.

The very high speed of light (and of EM propagation) is one of the reasons the previous EM technologies, including photon propulsion are not very efficient. There are, fortunately, ways to slow down light and thus improve efficiency. This invention includes the use of materials having electrical properties that include a reduced propagation speed. The dielectric core material 102 between the EM coils 101 does this.

As indicated earlier, even photon propulsion efficiency could be improved if light (within and around the propulsion system) were slower. For example, with a universe having a speed of light of 1 meter/second, one watt of power could produce one Newton thrust. The problem involved with trying to implement this and similar approaches is that when the light hits an object or passes through an interface into the real universe, momentum transfer essentially balances the forces on the system. The result is at best the same as current photon propulsion concepts. The EM propulsion system also appears to be affected by this problem. This problem is created, at least in part by the interface between the insulation on the coil wire 101 and the spacer material 102. However, there is another benefit with this invention's design that results in an increase in efficiency because of the lower propagation velocity. This lower velocity allows us to reduce the operating frequency, resulting in a reduced circuit impedance (and lower voltages), without requiring an increase in the spacing between the EM coils.

Both the separation between the EM circuits and the frequency of the two signals can simultaneously be reduced if we reduce the propagation speed of the magnetic field between the coils. That is the purpose of the dielectric spacer core (with a high dielectric coefficient) between the two coils. For this invention, spacer cores made of Barium Titanate have been focused on because of its abundance and its electrical properties. Other materials may also be used for this spacer core; however none else were analyzed here, but are discussed some below. As a result of reducing the EM propagation velocity, the impedance of each circuit is reduced, increasing circuit currents and magnetic fields.

A question might come up as to why use dielectric materials when we are focusing on the magnetic fields. First, if we follow the development of Ampere's law from electrostatics using special relativity, then the dielectric material reduces the propagation speed of magnetic fields, just as with the electric fields. Maxwell's equations also provide the same results. Ferrite materials could also be used for the spacer core, resulting in both a lower propagation speed and higher magnetic fields between the coils. The ferrite materials could also be used to focus the magnetic fields. However the use of ferrites also greatly increases the impedance of each coil, resulting in a lower efficiency. It also greatly increases the voltages and the problems associated with very high voltages. Another important factor for not using ferrite materials is that there are no force interactions between the dielectric spacer core and the magnetic field. This may not be the case with ferrous and ferrite materials. For maximum efficiency and simplicity, we want to confine the forces to just the currents within the wires. A possible compromise to this approach could be the use of a composite core made of a mixture of dielectric and ferrite materials. This would have a propagation speed lower than either dielectric or ferrite singly. Again, we need to consider the systems' impedances and the force interactions between the dielectric and ferrite composite material, and the magnetic field.

(b) Addressing System Impedance with Tuned Circuits

The use of tuned LCR circuits for each of the two EM circuits can significantly reduce the overall circuit impedance, and as a result, significantly increase efficiency. This method does not reduce each coil's inductive reactance, but rather attempts to match it with the capacitors opposite capacitive reactance. The result, for a perfect inductive and capacitive match is that only the circuit resistance contributes to the impedance. There will, however, always be some error in attempting to match inductive & capacitive reactance. The ability to tune the frequency produced by the master oscillator as well as the capacitance or inductance of the two EM circuits provides a set of inputs for better matching inductive & capacitive reactance.

Any mismatch between the two EM circuits results in each having a different tuned frequency. A possible approach to reducing this mismatch effect further can involve a straddling approach and be done by using a frequency modulate master oscillator. The frequency modulation signal's bandwidth can be set between the two different tuned frequencies to operate in a frequency region that minimizes impedance.

We still need to minimize each reactance in order to achieve a low system impedance. From this point of view, high operating frequencies are still undesirable. Also, at high frequencies, very high voltages can be generated across each of the coils and capacitors, resulting in a requirement for wires and capacitors capable of withstanding those voltages. As discussed above, a large coil inductance is a penalty for coils capable of creating a large magnetic field. Thus, this design must involve tradeoffs in the EM circuit designs. Space and weight limitations and constraints can also limit the coil sizes.

(c) Effects and Use of Mutual Impedance

Up to now, the effects of mutual impedance of the coils have not been discussed. Mutual impedance between the two EM coils can result in additional voltages induced within the two circuits. As a result of this design, the induced voltage in each EM coil is either in phase or 180 degrees out of phase with the voltages supplied by the two amplifiers. The effect of this induced voltage can be minimized by adjusting the circuit tuning to include this voltage. While mutual inductance can be a nuisance, it can also provide a beneficial effect.

Figure 3A:
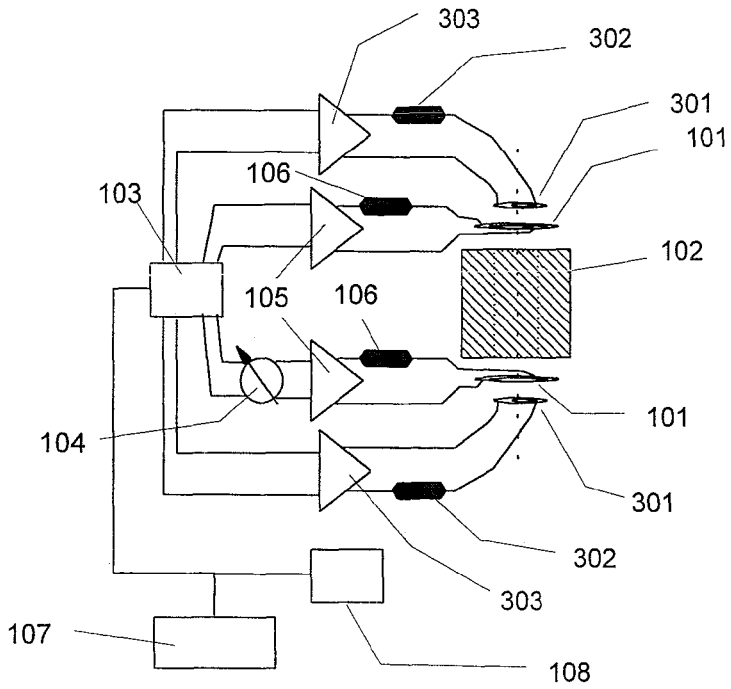
FIGS. 3A and B show the Embodiment that includes auxiliary tuning circuits.
Figure 3B:
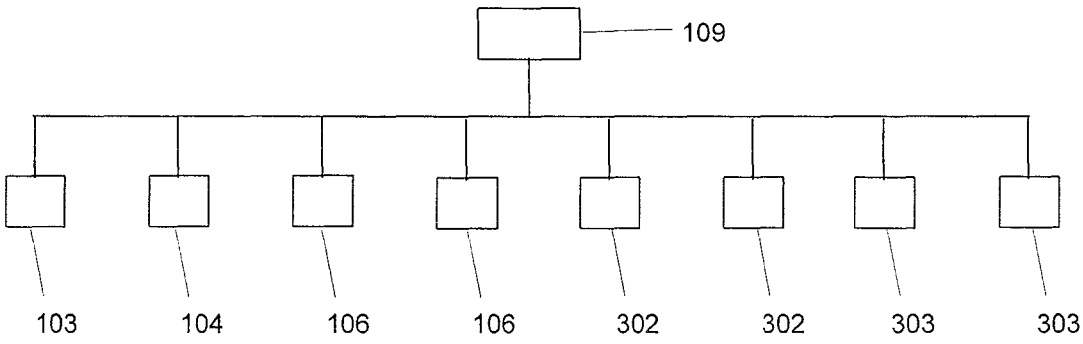

The use of two auxiliary units, shown in FIG. 3A, can use mutual impedance effects, rather than variable capacitors or variable inductors for precise circuit tuning. The auxiliary coils 301 are not used to match impedances exactly as was done in the tuning circuits, but rather match the voltages across the capacitive and inductive parts to minimize their voltage components. For this application, this serves the same effect. The principal reason for using this approach is that all the controls can be implemented and controlled using low voltage components. This control is done by adjusting the power and phase of the signals for each of auxiliary coils. The electronics generating the auxiliary signals need to be high precision. They can be digital, analog or a combination of both. The tuning capacitors 106 can still be used for rough matching.

This approach however complicates the systems somewhat. Mutual impedance is a two-way effect. All of the coils (main and auxiliary) are mutually linked with all of the other coils in the system. Un-intentional voltages will be induced in each coil which must be accounted for by the controller. The auxiliary circuits are relatively low power and thus their effect and control is minimal.

(d) Addressing Wiring Resistance on System Impedance

The basic embodiment up to this point involves technologies that have been available and used in other applications for a considerable time. Two more recent technologies are included in this document that can significantly increase the system's efficiency. The first new technology can be used to further reduce electrical resistance within the circuits. The second, included in the other design embodiments section below, is a method for greatly reducing the RF propagation velocity within the core separating the two EM coils.

With precisely tuned EM circuits, the resistance within the circuit wiring becomes the dominant part of circuit impedance. The use of large gauge wiring and/or silver wiring can lower the circuit resistance Even better, the use of an RF superconducting material for circuit wiring results in a significant reduction in resistance. While superconducting materials have been studied and used for some time now, their use for RF applications is relatively new. The current technology for RF superconductors does not provide the extreme levels of resistivity improvements as seen in DC applications. The current technology that we are aware of for RF superconducting conductors (used in a LINAC accelerator application) result in about a 200 times increase (including power required for cryogenic cooling) in efficiency over copper conductors. Even the moderate level of improvement in resistivity results in large improvements in the efficiency of the EM Propulsion system.

Figure 4:
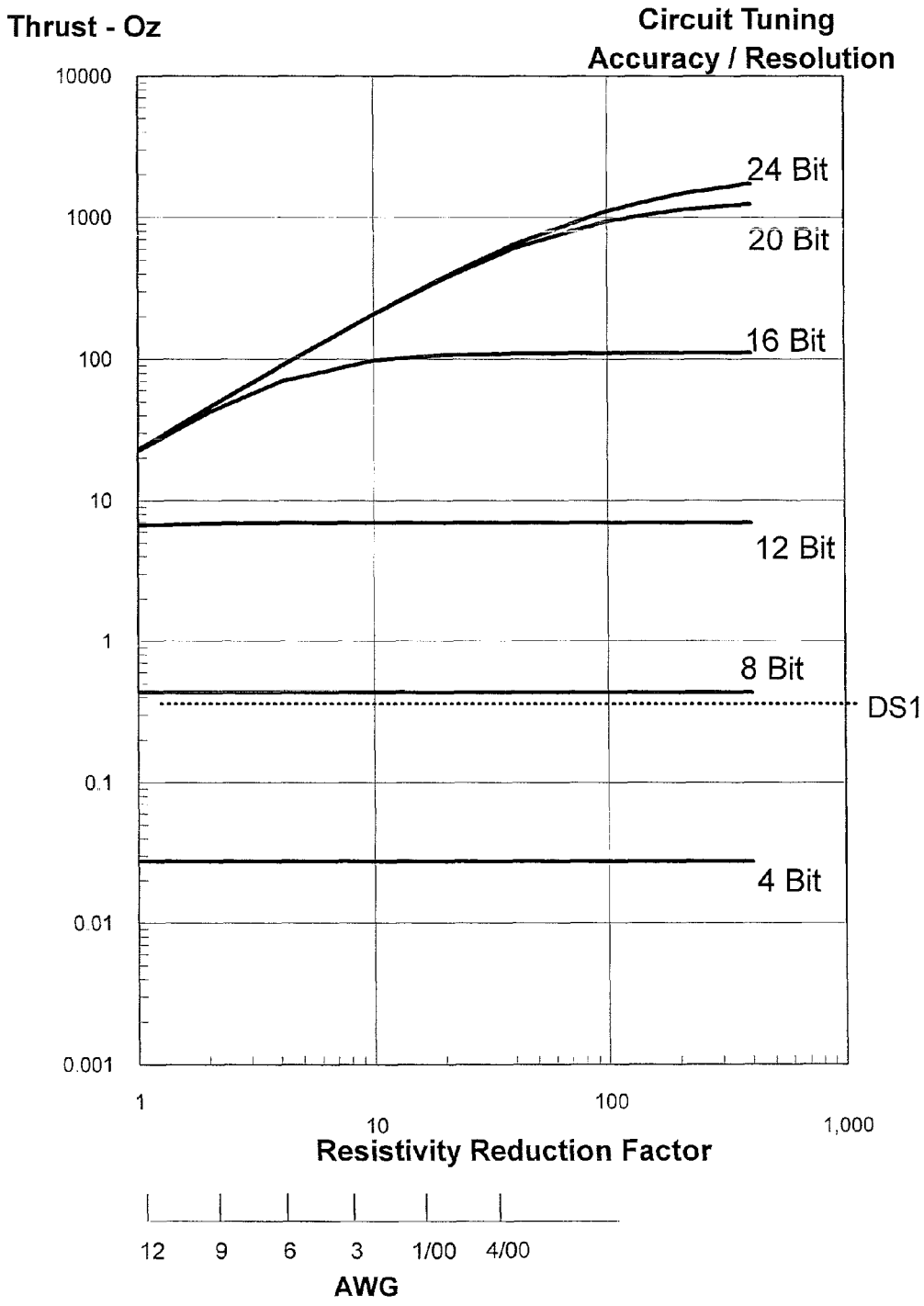
FIG. 4 shows the results of a parametric analysis of circuit tuning accuracy and resolution, and reductions to wiring electrical resistance. Also shown is the performance for the DS1 Ion engine. The parameters are relative to a baseline engine with specifications listed below.

Basic Embodiment Examples Analysis—FIG. 4

The effects of tuning accuracy (resolution) and reducing circuit resistances are shown in FIG. 4. Tuning accuracy is shown in terms of digital accuracy. Six plots show the tuning accuracy parametrics. Circuit resistance is shown (along the X-axis) relative to 12 AWG copper. A second axis also includes other AWG equivalents. The baseline circuit specifications for this parametric comparison include:

(1) a.25" inside diameter for each coil,
(2) 12 AWG high voltage copper (baseline resistivity=1) wiring,
(3) turns (each coil, flat windings),
(4) 2000 Watts total power,
(5) 1000 Watts for RF and 1000 Watts for cooling,
(6) a 50% efficiency in RF circuits (500 Watts for EM Circuits),
(7) 0.3" coil to coil spacing,
(8) Coil spacer made from Barium Titanate
(9) 52 MHz frequency,
(10) a 20% variable capacitor tuning range.

The result of this design is a force that is comparable to the attractive or repulsive force developed with two DC electromagnets having currents and coil windings the same as this invention. Also as with an electro-magnetic, the force developed using this invention is related more to the currents in the windings than the power used. The very low impedances result in very low power requirements.

Other Design Embodiments

A recent topic in Physics research that may also prove extremely useful for this concept involves slowing down pulses of light and radio waves. Light propagation speeds of 17 m/s have been demonstrated, and demonstrations of 0.01 m/s were being planned. he concept could also be applied to radio frequencies by using a discrete set of frequencies (an truncated Fourier series of a pulsed waveform). The set is propagated through different mediums having different dielectric coefficients, and then combined to form a composite (pulsed) waveform. The set of frequencies are selected such that their composite results in a waveform useable for this invention. The different mediums (dielectrics) are selected with different propagation speeds (at RF) that are based on the relations for light propagation in the above reference. The result is a discrete approximation to the results achieved for light. While any direct efficiency gains are questionable, this approach will significantly reduce the high voltage requirements and allow the system to operate directly at frequencies produced by an alternator power supply. This would also simplify the circuit tuning requirement and the use of pulsed and other signal waveforms.

Figure 5A:
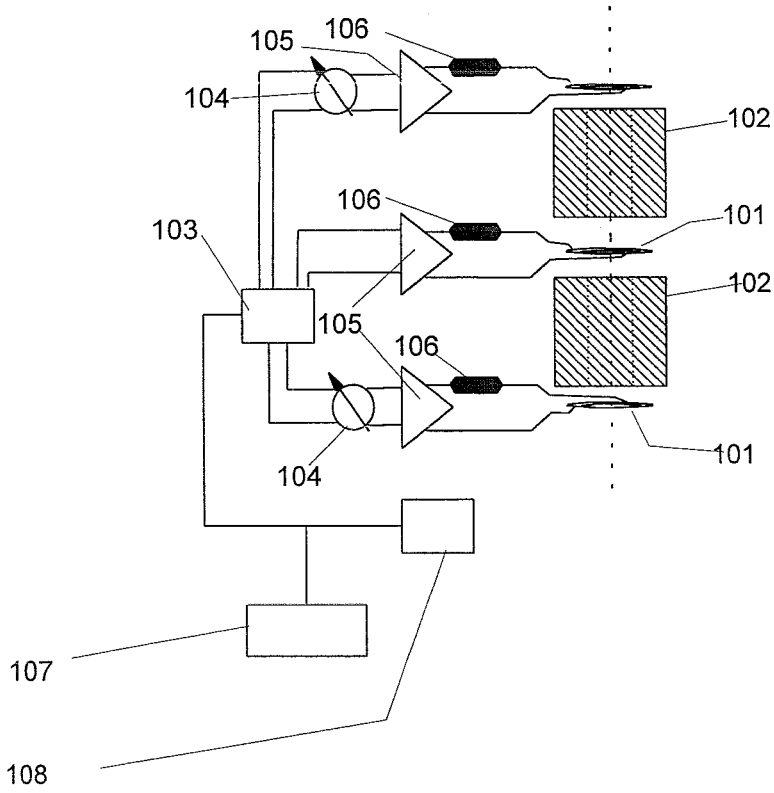
FIGS. 5A and 5B show other Embodiments of the invention.

The basic embodiment could also use back-to-back EM coils, where more than two circuits are used, as shown in FIG. 5A. Each successive coil has a relative signal phase that is 90 degrees above (or below) that of the previous coil. For a three circuit system, the relative phases are 0, 90 & 180 or 0, −90, and 180. This design can improve efficiency by using the magnetic fields emanating from both ends of each coil (except the end coils).

Another addition to the basic embodiment involves using devices that focus the electric (and magnetic) fields. This can reduce field dispersion losses. One possibility is to design the core similar to a dielectric lens, such as the Luneburg lens. Another possibility is to use a guard coil, with a similar function to a guard ring used with parallel plate capacitors. Ferrite devices could also be used; however initial investigations appear not to support this, as discussed earlier.

Figure 5B:
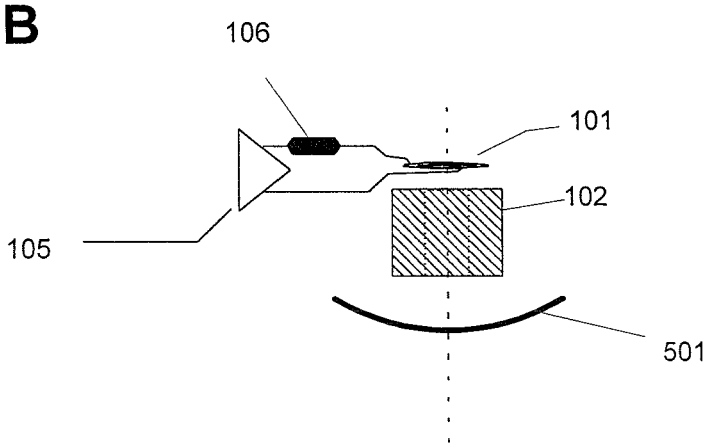

A modification of this focused field embodiment is shown in FIG. 5B. This design uses a single EM coil and a co-axial reflector 501 (or multiple reflectors) to direct the EM fields back to that coil. The reflector is a section of a sphere, with the coil placed at the center of the sphere. The coil to sphere distance is selected to give the proper phase shift to optimize force placed on the coil. This design is simpler to construct and operate since tuning involves only one circuit. This design can also use two reflectors; one on each side along the axis. Only limited analysis has been done for this design. Preliminary analysis, however, indicate that it is less efficient than the multiple EM coil designs. Part of this design can be used with the multiple coil designs to possibly increase efficiency. By placing two reflectors at the two ends of the coil—spacer—coil system, part of the end field loss from dispersion can be recovered.

Preferred Embodiment—Description and Operation—FIGS. 6A, 6B, 6C, 6D and 7

Figure 6A:
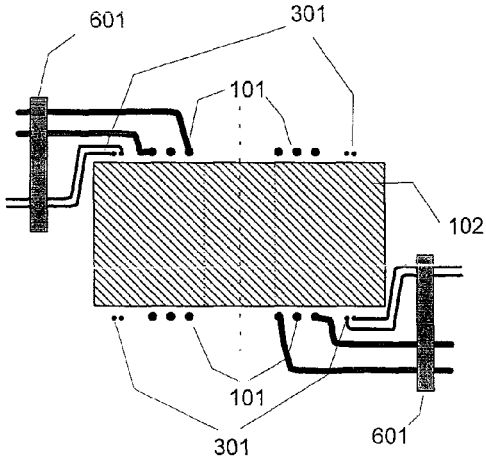
FIGS. 6A to 6D show various views and components of the Preferred Embodiment system.
Figure 6B:
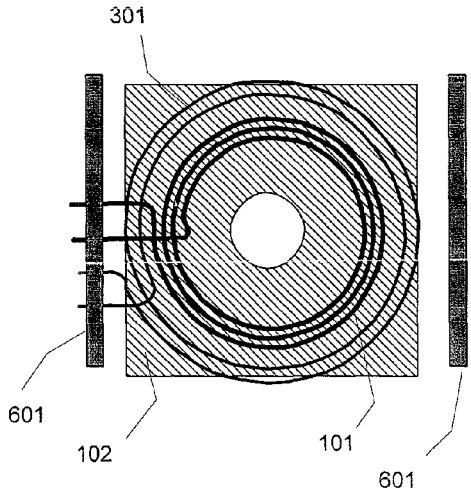
Figure 6C:
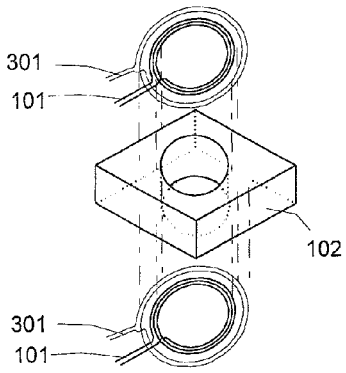
Figure 6D:
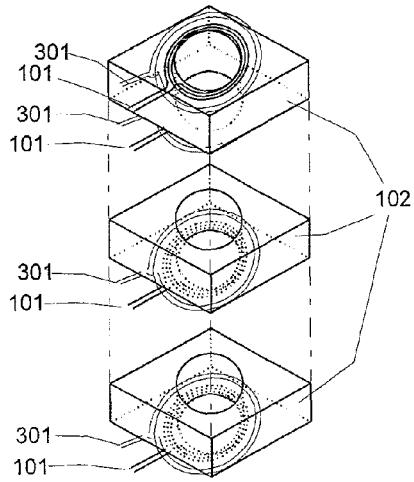
Figure 7:
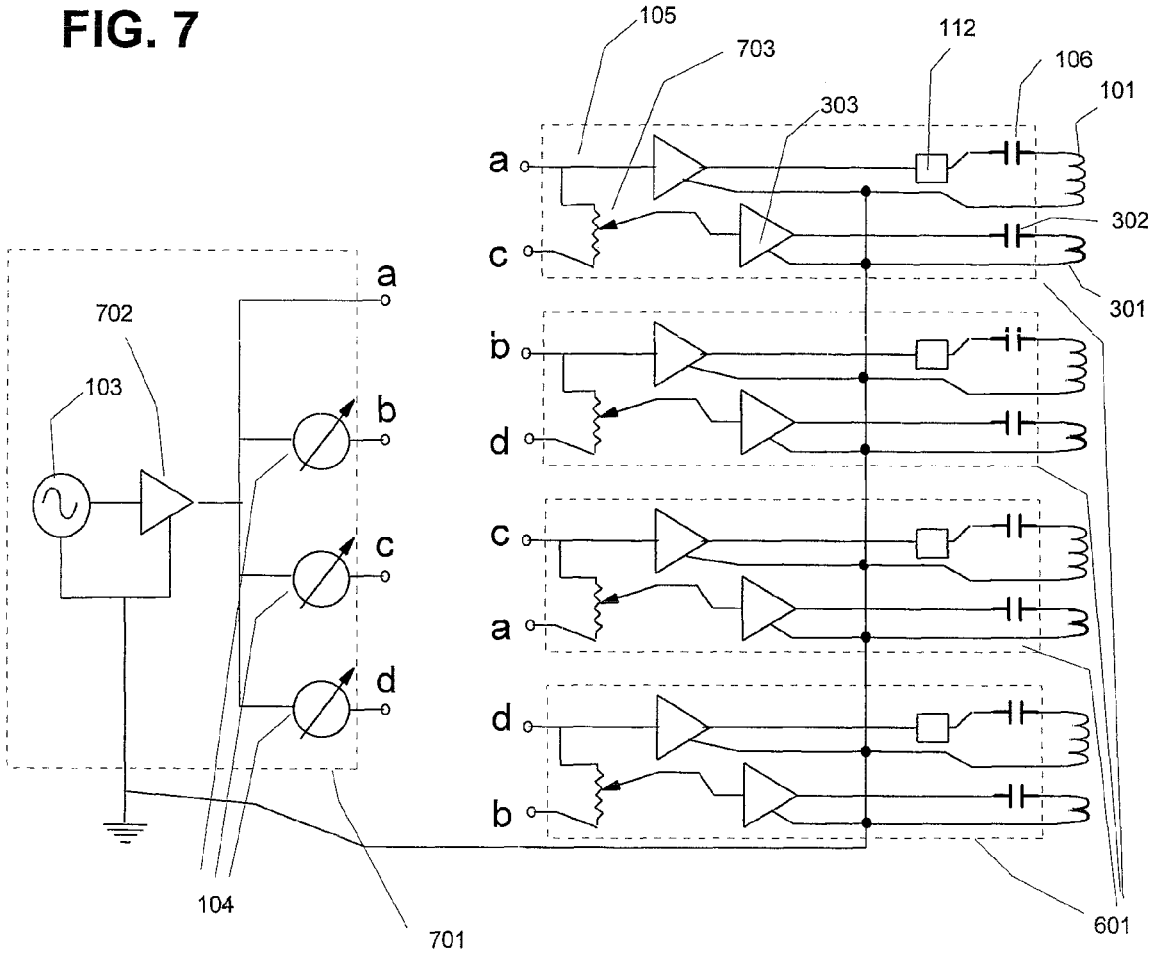
FIG. 7 shows the electrical schematic for the Preferred Embodiment system.

This embodiment is derived from the basic embodiment, with the addition of auxiliary tuning circuits (FIG. 3A, 301) and the back-to-back EM coils design (FIG. 5). The use of RF superconducting wiring is also a candidate for use. This embodiment is shown in FIG. 6A through 6D and FIG. 7. FIGS. 6A and 6B show side and top views for the principal components for a basic building block for this embodiment. FIG. 6C shows an expanded 3D view of this block, while FIG. 6D shows a module that is made from multiple blocks. This embodiment is composed of four EM coils 101, each with its supporting electronics circuit board 601 and three spacer cores 102. The four circuit boards are identical except for their input signal phases and their placement around the system. This placement reduces the lengths of connecting wire segments and minimizes circuit impedances. The use of four systems is a convenient module size that provides an optimum mix of efficiency and construction simplicity. Also, multiple identical modules can be coaxially combined with only an additional spacer core 102 between modules. This also allows the low impedance component circuit boards to be mounted on any of the four (Y-Z) edges of each module. FIG. 7 shows an electronic schematic of components of a module.

The operation of this embodiment is based on that for the basic embodiment and the embodiment variations associated with the basic. Each adjacent set of two EM coils 101 operate similar to the basic embodiment's operation. Each EM coil 101 operates at the same frequency, but with relative phases of: 0, 90, 180, and 270 degrees (from points a, b, c and d respectively in FIG. 7). Reversing the relative phases to 0, 270, 180, and 90 reverses the direction of the force produced.

Each auxiliary coil 301 operates either in or out of phase with its associated EM coil 101. The auxiliary circuit receives both in and out of phase signals from the signal generator, which are then combined to produce the appropriate auxiliary circuit power to maximize current through the EM coil 101 and tuning capacitor 106. The systems generated force is maximized when current through the EM coil 101 and tuning capacitor 106 is maximized. This occurs when the total voltages induced (self+mutual inductance) in the EM coil 101 exactly cancels the voltage across the tuning capacitor 106. A method for optimizing this force involves a control loop that measures the voltage across the tuning capacitor 106, and based on that voltage, adjusts the signal going to the auxiliary coil 301.

Rather than using a combination of conventional insulated wiring in the EM coils 101 and a separate dielectric spacer core 102, the system can use a single homogeneous dielectric structure with the wiring embedded within the dielectric. This improves the overall system dielectric properties, which relate to efficiency. This design requires a dielectric material having both a high dielectric constant and high dielectric strength.

The embedded wiring for the EM coils 101 can make cooling the system more difficult. By using hollow wiring, coolant can pumped through the wiring to dissipate heating and supports cryogenic cooling for superconducting. Since most of the RF electrical currents are near the surface of the wiring, the hollow core can have little effect on the wiring's electrical resistance.

Figure 8A:
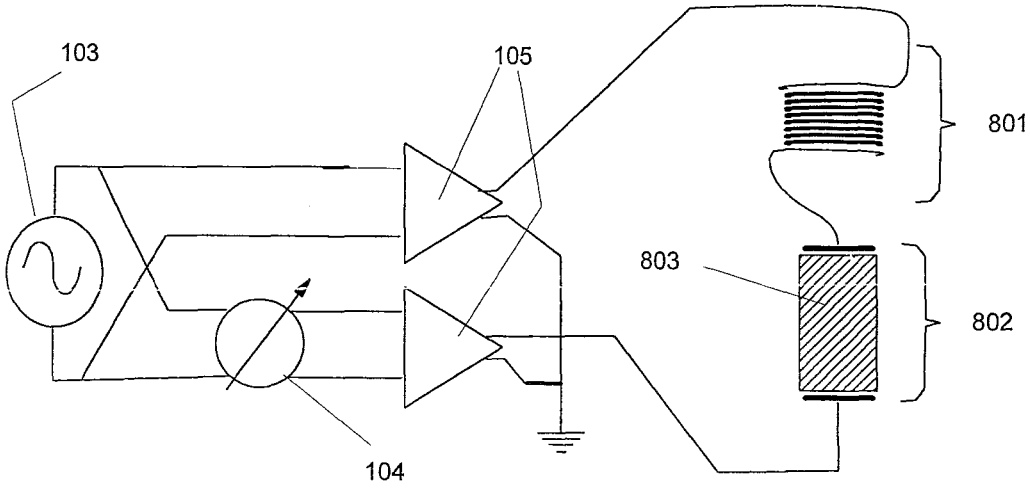
FIGS. 8A and 8B show Embodiments that use electrostatic forces.
Figure 8B:
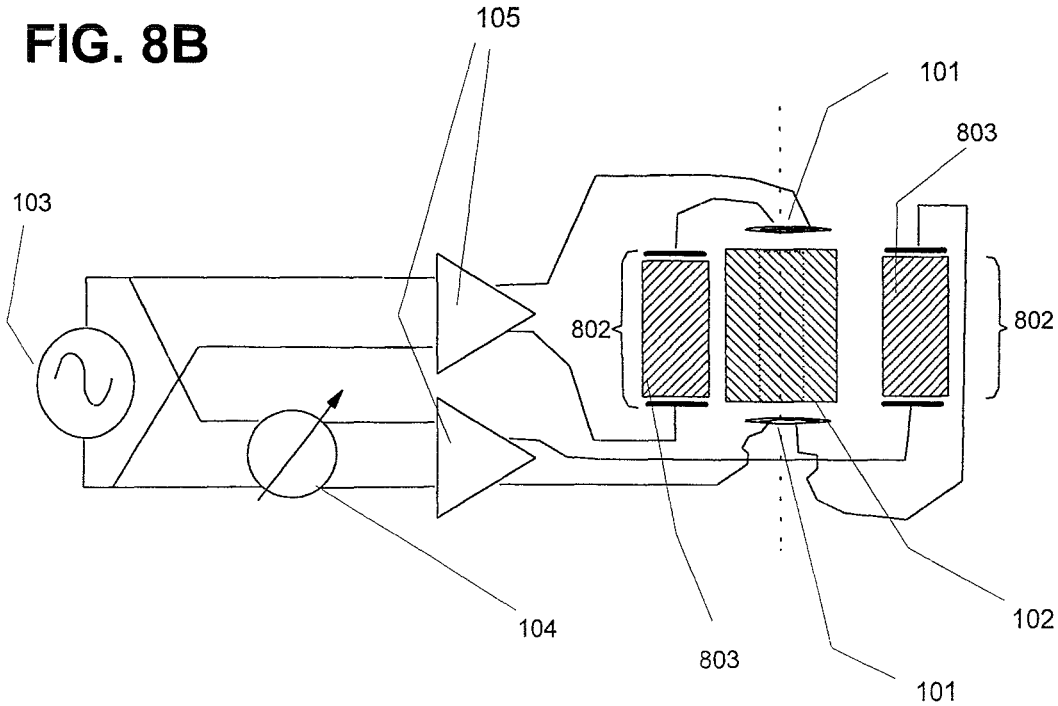

Alternative Embodiment—FIGS. 8A and 8B

A third form for this EM Propulsion System is one that uses electric rather than magnetic forces. This embodiment makes use of the forces between electric charges on the plates of a parallel plate capacitor. The capacitor 802 is connected to signal generator, phase control and amplifier circuits similar to that discussed in the previous embodiments. It also includes a variable inductor 801, in series with the capacitor. A set of out of phase sinusoidal voltages are applies to each plate similar to that applied to the EM coils above. Between the plates is a spacer 803 made from a material that results in a reduction in propagation speed for the electric fields in a manner similar to that for the EM fields above. FIG. 8A shows an electric field capacitor implementation that parallels the magnetic field coil version. This implementation actually is considerably simpler than the EM coil version. For example, while the system also requires tuning for optimization, only one circuit needs to be tuned. Circuit tuning can be done by either changing the capacitance or inductance, or simply changing the operating frequency. Although this embodiment is simpler than that for the first embodiment, preliminary analysis also indicates this version is less efficient than the magnetic coil version.

Since each of the magnetic coils in the previous embodiments use tuning capacitors for improving efficiency, we could also use these capacitors 802, along with the coils 101, to generate forces. FIG. 8B shows a hybrid configuration that uses a combination of electric and magnetic forces. For this design, the coil spacer core 102 and capacitor cores 803 use materials and have similar signal propagation delays. The axes of the capacitors need to be aligned parallel to the EM coils, with the polarity across each capacitor in the proper direction so that forces do not cancel. Also, any significant power losses across the capacitors need to be avoided.

This embodiment can also be constructed using multiple circuits in a back-to-back design similar to the EM counterpart shown in FIG. 5. The use of RF superconductor wiring can also be used for this embodiment for improving efficiency.

Conclusion, Ramifications, and Scope

From the foregoing, it should be apparent that the EM propulsion and communication system of the invention represents a quantum jump in efficiency for space propulsion systems. It can be embedded in modules that are placed throughout the entire interior and exterior of the vehicle, rather at the rear end, which is the least stable of all locations. It can use multiple modules, resulting in a significant improvement in reliability and a graceful degradation in performance if modules fail. It can provide six degrees of freedom (X, Y & Z translations and Roll, Pitch & Yaw rotations) control. It can operate in a vacuum, in air and perhaps under water. Since it emanates RF energy, it can also serve a communications role.

The construction of the preferred embodiment involves techniques that have been in use for some time, and can easily be economically mass produced using these techniques. It can also incorporate newer technologies that improve efficiency.

While the above description contains several specific examples, these should not be construed as limitations on the scope of the invention, but rather as an exemplification of one or more preferred embodiments thereof. Many other variations are possible. For example, other signal waveforms could be used rather than the one considered here. Also, different specifications, arrangements or modifications of the coils, circuits, core materials, wiring materials and shapes, and other components do not change the principles presented here. Similarly, modifications or additions to the supporting equipment, such as power or cooling, including cryogenic, do not change the principles presented here. Accordingly, the scope of the invention should be determined not by the embodiments illustrated, but by the appended claims and their legal equivalents.

What is claimed is:

1. An electronic propulsion engine that creates a propulsive force to propel vehicles, the electronic propulsion engine comprising:

at least two electromagnetic transducer circuits, each containing a transducer in a linear, coaxial configuration, fixed relative to each other and separated by a predetermined distance;

an electronic signal generator that produces at least two waveform signals which are applied to the at least two electromagnetic transducers to produce an electromagnetic field therebetween;

a medium, located in the space between the at least two electromagnetic transducers, that efficiently propagates the electromagnetic field present between the at least two electromagnetic transducers;

an electrical power supply which supplies electrical power to each of the at least two electromagnetic transducer circuits and wherein the at least two electromagnetic transducer circuits comprise at least two electromagnet coils which are powered by the electronic signal generator, a phase shifter, and two high efficiency amplified circuits that result in two distinct wave form signals having the same frequency, but with one 90 degrees out of phase with the other.

2. The electronic propulsion engine of claim 1, wherein the two distinct waveform signals are selected from among the group consisting of a single frequency sine wave waveform, pulsed waveform or complex waveform signal.

3. The electronic propulsion engine of claim 1, wherein the medium which is present in the space between the at least two electromagnet coils increases the propagation efficiency by reducing the propagation velocity of the electromagnetic field present between the at least two electromagnet coils.

4. The electronic propulsion engine of claim 3, wherein the medium which is present in the space between the at least two electromagnet coils is barium titanate.

5. The electronic propulsion engine of claim 1, wherein the at least two electromagnetic transducers circuits comprises a single transducer array, and wherein the electronic propulsion engine includes multiple transducer arrays in a stacked configuration.

6. The electronic propulsion engine of claim 1, wherein the at least two electromagnet coils present in the at least two electromagnet transducer circuits act upon the electromagnetic field which is created in the space between the at least two electromagnet coils in the at least two electromagnet transducer circuits, and wherein the medium which is located in the space between the at least two electromagnet coils includes an element which acts to focus the electromagnetic field to prevent excess dispersion of the electromagnetic field.

7. The electronic propulsion engine of claim 1, wherein the at least two electromagnet transducer circuits which are present in the electronic propulsion engine use a selected technique to increase the efficiency of the electronic propulsion engine, and wherein the technique which is utilized is to provide reduced electrical impedance in the at least two electromagnet transducer circuits as a result of circuit tuning.

8. The electronic propulsion engine of claim 1, wherein the electronic at least two electromagnet transducer circuits which are present in the electronic propulsion engine use a selected technique to increase the efficiency of the electronic propulsion engine, and wherein the technique which is utilized is mutual impedance coupling.

9. The electronic propulsion engine of claim 1, wherein the at least two electromagnet transducer circuits which are present in the electronic propulsion engine use a selected technique to increase the efficiency of the engine, and wherein the technique which is utilized comprises minimizing operating frequency dependency losses in the circuits.

10. The electronic propulsion engine of claim 1, wherein the at least two electromagnet transducer circuits which are present in the electronic propulsion engine use a selected technique to increase the efficiency of the engine, and wherein the technique which is utilized is reduced dispersion of the electromagnetic field as a result of field control and guiding.

11. The electronic propulsion engine of claim 1, further comprising a cooling system for cooling the at least two electromagnet transducer circuits.

12. The electronic propulsion engine of claim 1, further comprising a structural housing for the at least two electromagnet transducer circuits, the housing being formed of a lightweight synthetic material.

13. The electronic propulsion engine of claim 1, wherein electrostatic transducers and electrostatic fields and forces are used for propulsive force generation.

14. The electronic propulsion engine of claim 1, wherein a combination of electromagnetic and electrostatic transducers, and electromagnetic and electrostatic fields and forces are used for propulsive force generation.

15. The electronic propulsion engine of claim 1, wherein a single electromagnetic or electrostatic transducer and reflector lens element is used for propulsive force generation.

16. The electronic propulsion engine of claim 1, wherein the signals are modulated in a scheme for radio communications purposes.

* * * * *